US007974428B2

(12) United States Patent
Klinkby et al.

(10) Patent No.: US 7,974,428 B2
(45) Date of Patent: Jul. 5, 2011

(54) HEARING AID WITH ACOUSTIC FEEDBACK SUPPRESSION

(75) Inventors: Tjalfe Kristian Klinkby, Varlose (DK); Thilo Volker Thiede, Ballemo (DK)

(73) Assignee: WIDEX A/S, Lynge (DK)

( * ) Notice: Subject to any disclaimer, the term of this patent is extended or adjusted under 35 U.S.C. 154(b) by 1540 days.

(21) Appl. No.: 11/356,060

(22) Filed: Feb. 17, 2006

(65) Prior Publication Data

US 2006/0140429 A1 Jun. 29, 2006

Related U.S. Application Data

(63) Continuation-in-part of application No. PCT/EP03/09301, filed on Aug. 21, 2003.

(51) Int. Cl.
*H04R 25/00* (2006.01)

(52) U.S. Cl. ..... 381/318; 381/71.11

(58) Field of Classification Search ..... 381/312, 381/318, 71.11, 321
See application file for complete search history.

(56) References Cited

U.S. PATENT DOCUMENTS

| | | | |
|---|---|---|---|
| 5,091,952 | A | 2/1992 | Bustamante |
| 5,375,145 | A | 12/1994 | Johnson |
| 6,480,610 | B1 | 11/2002 | Fang |
| 2003/0053647 | A1 | 3/2003 | Kates |

FOREIGN PATENT DOCUMENTS

| | | | |
|---|---|---|---|
| DK | EP 1191813 | A1 * | 9/2000 |
| DK | EP 1191814 | A1 * | 3/2002 |
| WO | WO 2005/020632 | A1 * | 3/2005 |

* cited by examiner

*Primary Examiner* — Fan Tsang
*Assistant Examiner* — Phylesha Dabney
(74) *Attorney, Agent, or Firm* — Sughrue Mion, PLLC

(57) ABSTRACT

A hearing aid having an input transducer (2), a signal processor (3), an output transducer (4) and an adaptive filter (5) for generating a feedback cancellation signal (101) further comprises a norm estimator (10) generating a first norm signal (109) indicative of a norm of the electrical input signal and a second norm signal (110) indicative of a norm of a feedback-cancelled electrical input signal, a comparator for comparing the first and second norm signals and generating a difference value $N_{fbc}-N_x$ and a decision unit disabling application of the feedback cancellation signal to the signal path of the hearing aid if the difference value is above a certain threshold value $c_{th}$ thus avoiding the feedback cancellation mechanism actually increasing acoustic feedback of the hearing aid. The invention also provides a method for reducing acoustic feedback of a hearing aid, a computer program, and an electronic circuit for a hearing aid.

27 Claims, 4 Drawing Sheets

HEARING AID WITH ACOUSTIC FEEDBACK SUPPRESSION

RELATED APPLICATION

The present application is a continuation-in-part of application No. PCT/EP2003/09301, filed on Aug. 21, 2003, and published as WO 2005/020632 A1.

BACKGROUND OF THE INVENTION

1. Field of the Invention

The invention relates to the field of hearing aids. The invention, more specifically, relates to a hearing aid having an adaptive filter for generating a feedback cancellation signal, to a method of reducing acoustic feedback of a hearing aid and to an electronic circuit for a hearing aid.

2. The Prior Art

Acoustic feedback occurs in all hearing instruments when sounds leak from the vent or seal between the earmould and the ear canal. In most cases, acoustic feedback is not audible. But when in-situ gain of the hearing aid is sufficiently high, or when a larger than optimal size vent is used, the output of the hearing aid generated within the ear canal can exceed the attenuation offered by the earmould/shell. The output of the hearing aid then becomes unstable and the acoustic feedback becomes audible, e.g. in the form of a whistling noise. For many users, and for the people around, such audible acoustic feedback is an annoyance and even an embarrassment. In addition, hearing instruments that are at the verge of feedback, i. e. sub-oscillatory feedback, may influence the frequency characteristic of the hearing instrument and lead to intermittent whistling.

WO-A1-02/25996 shows a hearing aid with an adaptive filter to compensate for the feedback. The adaptive filter estimates the transfer function from output to input of the hearing aid including the acoustic propagation path from the output transducer to the input transducer. The input of the adaptive filter is connected to the output of the hearing aid and the output signal of the adaptive filter is subtracted from the input transducer signal to compensate for the acoustic feedback.

The adaptive acoustic feedback cancellation systems as described above allow a substantial suppression of acoustic feedback, thereby allowing an increase of 10 to 12 dB of usable gain, as is e. g. described in Kuk, Ludvigsen and Kaulberg, "Understanding feedback and digital feedback cancellation strategies" in The Hearing Review, February 2002, available at http://www.hearingreview.com/Articles.ASP?articleid=H0202F04. This article also gives a comprehensive overview of the phenomenon of acoustic feedback with hearing instruments and strategies to suppress this feedback.

Nevertheless, there remain problems associated with adaptive feedback cancelling. The correlation analysis is performed to estimate the feedback path. This is based on the assumption that a feedback signal is a highly correlated version of the original signal. If higher correlation is observed, but the duration of the correlation analysis is short, the system may suggest the presence of feedback when actually no such feedback has occurred. This is an artifact of the feedback analysis algorithm. In real-life, most speech and music signals are highly correlated on short-term basis but not on a long-term basis. Thus, short-term correlation analysis on speech and music could result in cancellation of some signals, and could even lead to unpleasant sound quality and loss of intelligibility. This suggests that long-term correlation (i.e. slow feedback path estimation) should be used to avoid such artifacts.

On the other hand, if the feedback cancellation algorithm takes a long time to cancel the feedback signal, it may not be able to handle sudden changes in the characteristic of the feedback path. Audible feedback may still result until the feedback cancellation algorithm has successfully estimated and cancelled the feedback signal. Thus sudden changes, e.g. placing a telephone handset next to the ear, will result in whistling that may last several seconds before the feedback cancellation algorithm is effective in suppressing the annoying signal. This is undesirable and the successful algorithm should (ideally) handle sudden changes in the feedback path.

Moreover, the feedback cancellation algorithm may have different effectiveness in different frequency regions, i. e. provide an adequate feedback suppression in one frequency band while producing undesirable results in other frequency bands.

A further problem in the case of a relatively slow adaptation time constant occurs if a high-feedback environment suddenly changes into a low-feedback environment, e. g. if the hearing aid wearer puts back a telephone handset. The adaptive filter then subtracts (adds after inversion) from the signal path a strong feedback cancellation signal which no longer is needed for signal cancelling. In this case the adaptive filter actually generates a whistling sound rather than removing one. Acoustically this sound is indistinguishable from the sound of feedback, and therefore it is in common language referred to as feedback, although it would be more correct to say that it is due to the attempt by the adaptive filter to create a feedback cancellation signal.

SUMMARY OF THE INVENTION

It is therefore an object of the present invention to provide a hearing aid with improved feedback-cancellation properties. It is a further object of the invention to provide a method of reducing acoustic feedback of a hearing aid having improved feedback-cancellation properties.

The invention, in a first aspect, provides a hearing aid comprising an input transducer for transforming an acoustic input signal into an electrical input signal, a signal processor for generating an electrical output signal, an output transducer for transforming the electrical output signal into an acoustic output signal, an adaptive filter for generating a feedback cancellation signal, a means for subtracting the feedback cancellation signal from the electrical input signal to produce a feedback-cancelled electrical input signal, a norm estimator for generating a first norm signal indicative of a norm $N_x$ of the electrical input signal and for generating a second norm signal indicative of a norm $N_{fbc}$ of the feedback-cancelled electrical input signal, a comparator comparing the first norm signal with the second norm signal and generating a difference value $N_{fbc}-N_x$ between the norm of the feedback-cancelled input signal and the norm of the electrical input signal, and a decision unit disabling the application of the feedback cancellation signal into the signal path of the hearing aid if the difference value is above a certain threshold value c.

With the hearing aid according to the present invention it is possible to compare a norm of the electrical input signal without feedback compensation with a norm of the feedback controlled electrical input signal and disable the feedback cancellation in the signal path of the hearing aid if the difference of the two norms is larger than a particular threshold value, e. g. larger than zero. The hearing aid thus detects a situation when the feedback cancellation would actually increase the signal norm thus introducing additional feedback instead of suppressing it and prevents the feedback cancellation from affecting the signal path in these cases.

The feedback cancellation signal is still supplied to the filter control circuit in order to control the adaptive filter even if the feedback cancellation of the main signal of the hearing aid is disabled.

The result of the decision process of the hearing aid according to the present invention may also be used as an input parameter of the adaptation algorithm of the adaptive filter. It is e.g. possible to increase the adaptation speed when the feedback cancellation signal is switched off in the signal path, as in this situation artifacts caused by a fast adaptation will not be audible.

According to a preferred embodiment the norm signals are calculated according to the general formula:

$$N_m = \left(\sum_{k=1}^{L} F_k |m_k|^p\right)^{p^{-1}},$$

wherein $m_k$ is the k-th sample (k=1, . . . L) of the signal m=x, y of which the norm is to be calculated, $F_k$ represents a window or filter function and natural number p is the power of the norm. According to a particular embodiment of this formula p=1 and the filter function $F_k$ is defined by the following recursive formula:

$$N_m(k)=\lambda|x_k|+(1-\lambda)N_m(k-1),$$

wherein $\lambda$ is a constant $0<\lambda\leqq 1$.

The hearing aid may comprise a fading unit for soft fading in and out of the feedback cancellation signal instead of rapid switching of the same. The fading time constant may be between 0.1 s and 5 s, preferably between 0.5 s and 2 s. For fading a linear ramp function or other suitable functions like trigonometric or polynomial functions may be used.

According to a preferred embodiment the decision whether or not the feedback cancellation signal is introduced into the signal path is carried out independently for different frequency bands or frequency channels of the hearing aid thus enabling feedback cancellation in one frequency band while disabling feedback cancellation in a different frequency band. The hearing aid can thereby be adapted to the feedback conditions of the acoustic environment in different frequency bands.

The invention, in a second aspect, provides a method of reducing acoustic feedback of a hearing aid comprising an input transducer for transforming an input signal into an electrical input signal, a signal processor for generating an electrical output signal and an output transducer for transforming the electrical output signal into an acoustic output signal, comprising the steps of: generating an adaptive feedback cancellation signal, subtracting the feedback cancellation signal from the electrical input signal generating a feedback-cancelled input signal, generating a first norm signal indicative of a norm $N_x$ of the electrical input signal and a second norm signal indicative of a norm $N_{fbc}$ of the feedback-cancelled input signal, comparing the first norm signal with the second norm signal and thereby generating a difference value $N_{fbc}-N_x$, and disabling application of the feedback cancellation signal into the signal path of the hearing aid if the difference value $N_{fbc}-N_x$ is above a certain threshold value $c_{th}$.

The invention, in a third aspect, provides a computer program comprising program code for performing a method of reducing acoustic feedback of a hearing aid comprising an input transducer for transforming an input signal into an electrical input signal, a signal processor for generating an electrical output signal and an output transducer for transforming the electrical output signal into an acoustic output signal, said computer program comprising program steps for: generating an adaptive feedback cancellation signal, subtracting the feedback cancellation signal from the electrical input signal generating a feedback-cancelled input signal, generating a first norm signal indicative of a norm $N_x$ of the electrical input signal and a second norm signal indicative of a norm $N_{fbc}$ of the feedback-cancelled input signal, comparing the first norm signal with the second norm signal and thereby generating a difference value $N_{fbc}-N_x$, and disabling application of the feedback cancellation signal into the signal path of the hearing aid if the difference value $N_{fbc}-N_x$ is above a certain threshold value cth.

The invention, in a fourth aspect, provides an electronic circuit for a hearing aid comprising: a signal processor for processing an electrical input signal, derived from an acoustic input signal, and generating an electrical output signal, an adaptive filter for generating a feedback cancellation signal, a means for subtracting the feedback cancellation signal from the electrical input signal to generate a feedback-cancelled input signal, a norm estimator for generating a first norm signal indicative of a norm Nx of the electrical input signal and for generating a second norm signal indicative of a norm Nfbc of the feedback-cancelled electrical input signal, a comparator for comparing the first norm signal with the second norm signal and generating a difference value Nfbc−Nx between the norm of the feedback-cancelled input signal and the norm of the electrical input signal, and a decision unit disabling the application of the feedback cancellation signal into the signal path of the hearing aid if the difference value is above a certain threshold value.

Further specific variations of the invention are defined by the further dependent claims.

BRIEF DESCRIPTION OF THE DRAWINGS

The present invention and further features and advantages thereof will be more readily apparent from the following detailed description of particular embodiments of the invention with reference to the drawings, in which.

DETAILED DESCRIPTION OF THE INVENTION

Figure 5:
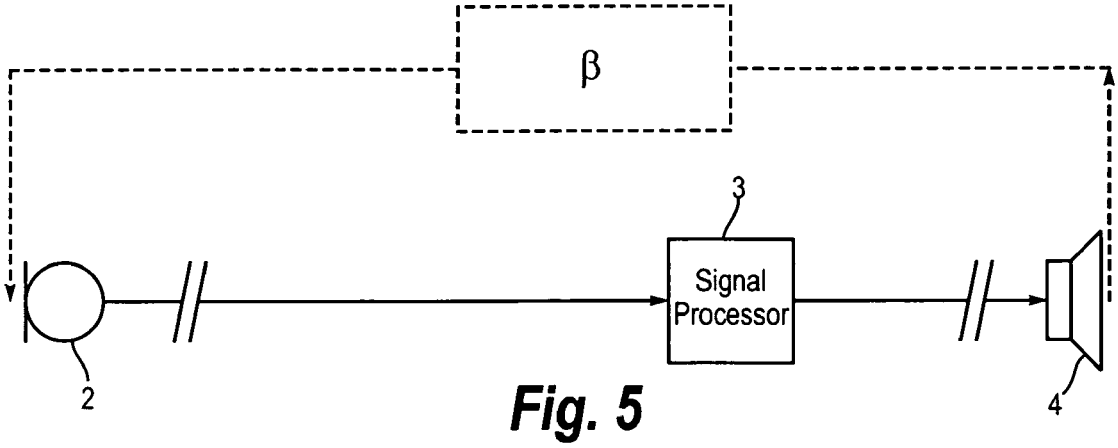
FIG. 5 is a schematic block diagram illustrating the acoustic feedback path of a hearing aid.

Reference is first made to FIG. 5 which shows a simple block diagram of a hearing aid comprising an input transducer or microphone 2 transforming an acoustic input signal into an electrical input signal, a signal processor 3 amplifying the input signal and generating an electrical output signal and an output transducer or receiver 4 for transforming the electrical output signal into an acoustic output signal. The acoustic feedback path of the hearing aid is depicted by broken arrows, whereby the attenuation factor is denoted by β. If, in a certain frequency range, the product of the gain G (including transformation efficiency of microphone and receiver) of the processor 3 and attenuation β is close to, or above, 1, audible acoustic feedback occurs.

Figure 6:
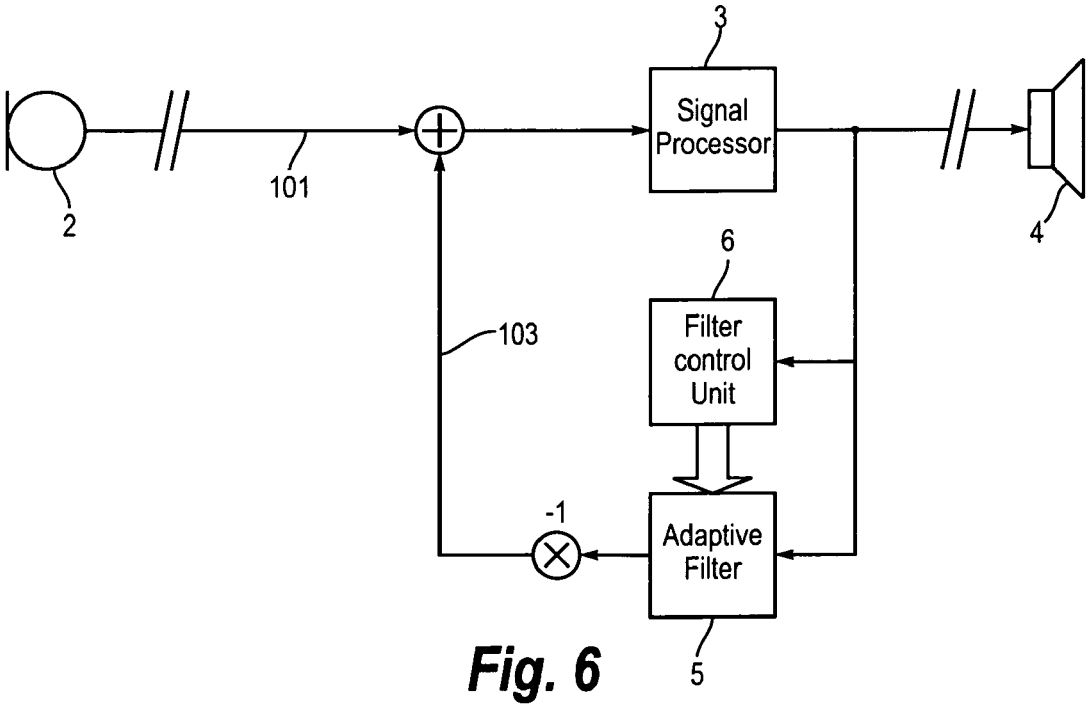
Fig. 6 PRIOR ART
FIG. 6 is a block diagram showing a prior art hearing aid.

Reference is now made to FIG. 6, which shows a system for a hearing aid according to WO-A1-02/25996. The output signal from signal processor 3 is fed to an adaptive filter 5. A filter control unit 6 controls the adaptive filter, e. g. the convergence rate or speed of the adaptive filtering. The adaptive filter constantly monitors the feedback path providing an estimate of the feedback signal. Based on this estimate a feedback cancellation signal is generated which is then fed into the signal path of the hearing aid in order to reduce or in the ideal case to eliminate acoustic feedback.

Figure 1:
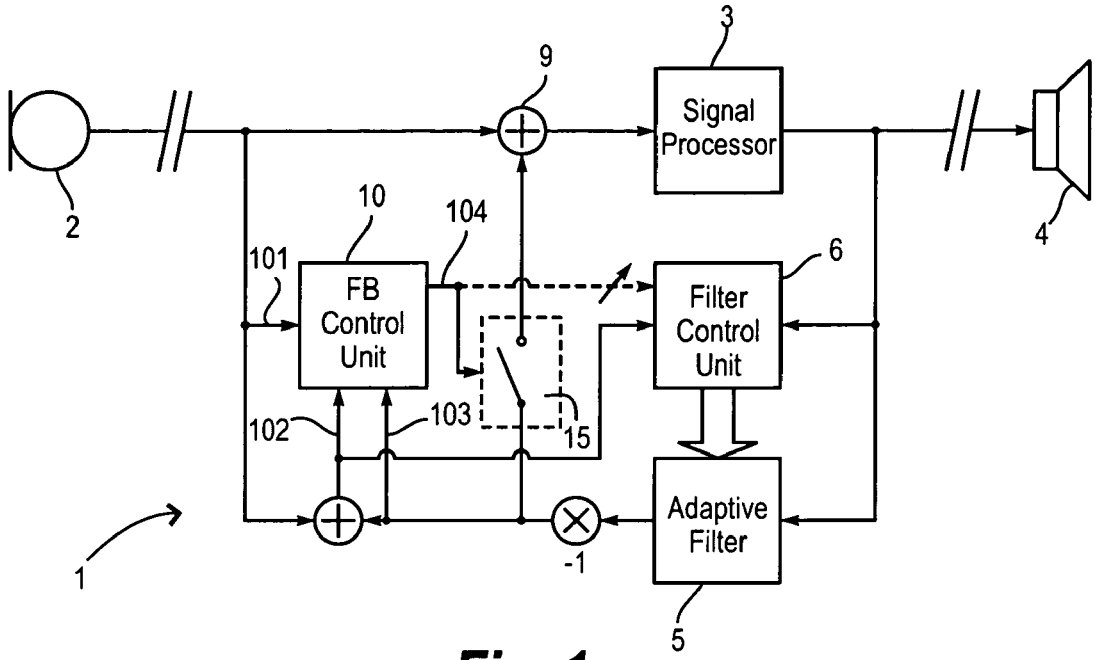
FIG. 1 is a block diagram of a hearing aid according to a first embodiment of the present invention.

Reference is now made to FIG. 1, which shows a block diagram of a first embodiment of a hearing aid according to the present invention.

The signal path of the hearing aid 1 comprises an input transducer or microphone 2 transforming an acoustic input signal into an electrical input signal 101, a signal processor or amplifier 3 generating an amplified electrical output signal and an output transducer (loudspeaker, receiver) 4 for transforming the electrical output signal into an acoustic output signal. The amplification characteristic of the signal processor 3 may be non-linear, providing more gain at low signal levels, and may show compression characteristics as is well known in the art.

The electrical output signal is supplied to the adaptive filter 5 and the filter control unit 6. The former monitors the feedback path and consists of an adaptation algorithm adjusting a digital filter such that it simulates the acoustic feedback path and so provides an estimate of the acoustic feedback in order to generate a feedback cancellation signal modelling the actual acoustic feedback path. The adaptation speed of the adaptive filter 5 is controlled by the filter control unit 6.

According to the invention a feedback control unit 10 is provided to which the input signal 101 and the feedback-cancelled input signal 102, i. e. the sum of the input signal 101 and the inverted feedback cancellation signal 103, are submitted. Based on these signals the feedback control unit decides whether or not the feedback cancellation improves or deteriorates the signal quality of the hearing aid signal and outputs a decision signal 104 which in turn operates a switch 15 switching on or off the supply of the feedback-cancelled input signal 102 to a summing node 9 in the signal path of hearing aid 1. The feedback cancellation signal is therefore applied to the signal path only in those cases in which the feedback control unit 10 decides that it provides an improvement of the hearing aid signal.

Figure 2:
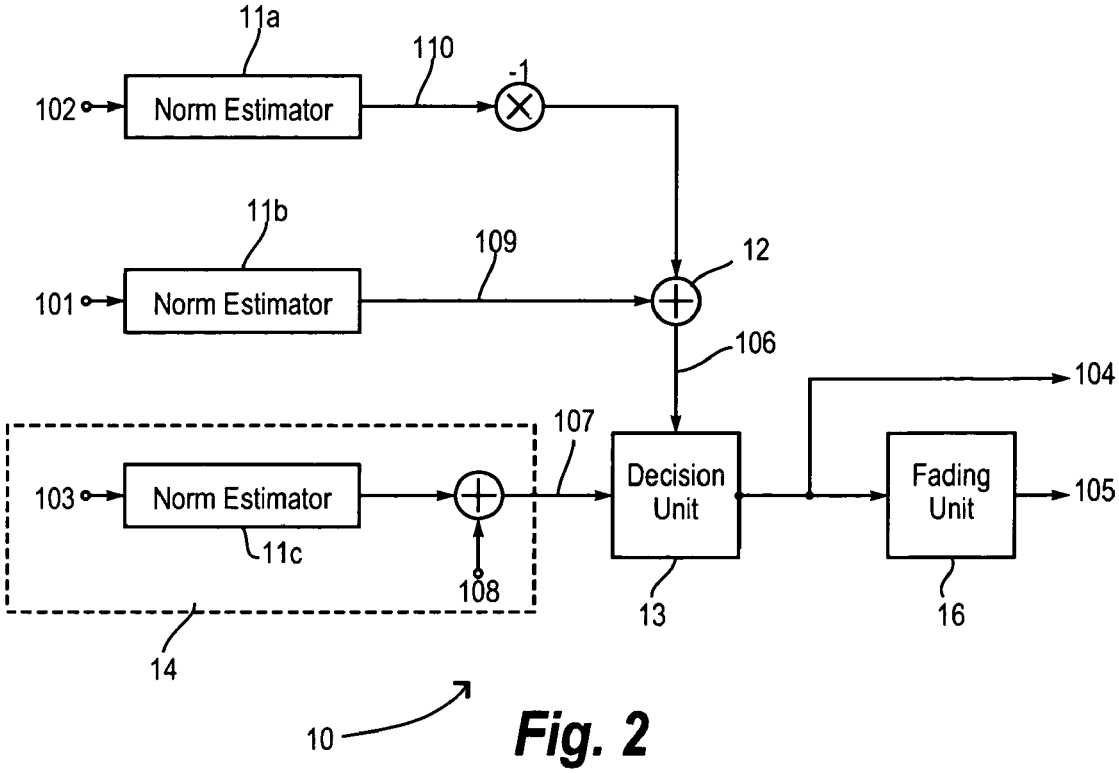
FIG. 2 is a block diagram of a feedback control unit of an embodiment of the hearing aid according to the present invention.

An embodiment of the feedback control unit 10 is shown in detail in FIG. 2.

The decision unit 10 comprises norm estimators 11*b*, 11*a* for estimating a norm, or a performance index, of the electrical input signal 101 and the feedback-cancelled electrical input signal 102, respectively, over a certain time window. The resultant first norm signal 109 and second norm signal 110 are subtracted at the summing node 12 (together with inverter for signal 110 forming a subtractor) outputting comparison signal 106 which is input to the decision unit 13, where the comparison signal indicative of the norm difference is in turn compared with a threshold value 107. This threshold value can either be zero, a constant value, or the threshold value output by threshold value generator 14, in which a norm of feedback cancellation signal 103 is calculated at norm estimator 11*c* and multiplied by a threshold factor 108.

The decision unit 13 compares the comparison signal 106 with the threshold value 107 and outputs to switch 15 a decision signal 104 depending on the comparison result. The switch 15 (FIG. 1) enables or disables supply of the inverted feedback cancellation signal at summing node 9 into the signal path of the hearing aid.

Figure 3:
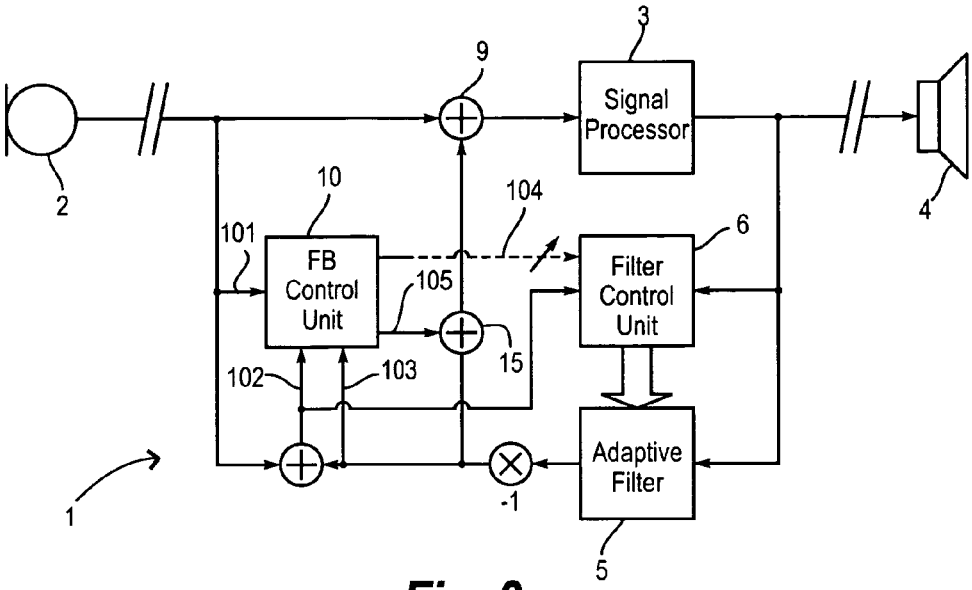
FIG. 3 is a block diagram of a second embodiment of the hearing aid according to the present invention.

Rather than switching the feedback cancellation signal on and off instantly into the signal path of the hearing aid it may be advantageous to softly fade the cancellation signal in or out over a time interval of between 0.1 s and 5 s, advantageously e.g. between 0.5 s and 2 s. For this purpose a fading unit 16 may be employed providing a fading signal 105 instead of decision signal 104 to a switch 15 consisting of a multiplier as shown in FIG. 3. The switching operation can e.g. be accomplished by a ramp voltage increasing the fading signal 105 from zero to the maximum voltage linearly over a time of e.g. 1 s and decreasing the voltage for the switching off operation with the same or with a different time constant. Instead of a linear fading function many other fading functions are possible, e.g. trigonometric or polynomial functions. As mentioned the fading need not be symmetrical; the fading in can occur at another time rate than the fading out. A fading function with hysteresis is also an option; the condition for switching the feedback cancellation either on or off must be satisfied for some time before the fading is initiated in order to avoid an erratic switching operation.

The present invention aims to avoid a generation of additional feedback by the feedback cancellation algorithm itself, e. g. in the case if a high-feedback environment abruptly changes into a low-feedback environment whereby the adaptation filter with a rather slow adaptation speed still tries to cancel the no longer existing, strong feedback by introducing into the signal path the feedback cancellation signal which is modelled as the inverted signal of the estimated feedback. In such cases the feedback cancellation operation in fact generates additional feedback. The present invention is based on the assumption that this undesired generation of extra feedback by the feedback cancelling algorithm itself can be identified by comparing a norm of the original signal with a norm of the feedback-cancelled signal. If the signal norm is increased by feedback cancellation it is assumed that additional feedback is produced instead of being removed. In these cases the feedback control unit 10 according to the present invention decides to disable the application of the feedback cancellation signal into the signal path of the hearing aid. The feedback cancellation signal is then only fed back to the filter control unit for the purposes of adaptation of the adaptive filter output. As discussed above, a constant value other than zero, or a threshold value depending on a feedback cancellation signal, may be employed for triggering the enabling/disabling decision.

The norm of a signal x(t) varying over time t and assuming positive as well as negative values is a non-negative value indicative of the size or quantity of the signal x. According to the invention the signal norm is calculated over a particular time window, i. e. a particular number L of samples $x_k$ (k= 1 . . . , L) of signal x. The weighting of the samples $x_k$ is expressed by the filter function $F_k$. The generalised norm of signal x can be expressed as follows:

$$N_x = \left(\sum_{k=1}^{L} F_k |x_k|^p\right)^{p^{-1}}, \quad (1)$$

whereby p ϵ N is the power of the norm. The most simple case is the 1-norm (p=1) in which equation (1) can be expressed as follows:

$$N_x = \sum_{k=1}^{L} F_k \cdot |x_k|. \quad (2)$$

In a preferred embodiment the filter function $F_k$ can be expressed by a recursive definition:

$$N_x(k)=\lambda|x_k|+(1-\lambda)N_x(k-1) \quad (3)$$

wherein λ is a normalisation constant having possible values between zero and 1.

For p→∞ equation (1) describes a further extreme case, i. e. the maximum norm:

$$N_x = \underset{(k=1,\ldots L)}{\text{Max}} |x_k| \quad (4)$$

A further possibility is the square norm (p=2) indicative of the signal energy:

$$N_x = \left(\sum_{k=1}^{L} F_k x_k^2\right)^{1/2} \quad (5)$$

For the present invention any suitable norm and time window may be used. The norm estimator calculates the norm $N_{fbc}=N_y$ of the feedback cancelled input signal y as well as the norm $N_x$ of the electrical input signal x. In the decision unit 13 the difference between the two norms is compared with a threshold value $c_{th}$:

$$N_{fbc}-N_x>c_{th}? \quad (6)$$

If the difference between the norm of the feedback-cancelled input signal and the input signal itself is larger than the threshold value it is assumed that the feedback cancellation generates more feedback than it cancels, and therefore a decision is made to remove it from the hearing aid signal path.

FIG. 3 illustrates a second embodiment of the hearing aid according to the present invention. The switch is replaced by a multiplication element which receives the fading signal 105 from fading unit 16 as shown in FIG. 2. With the embodiment of FIG. 3 a soft fading in or out of the feedback cancellation signal into the signal path of the hearing aid between input transducer 2 and signal processor 3 can be performed smoothly at the summing node 9.

Figure 4:
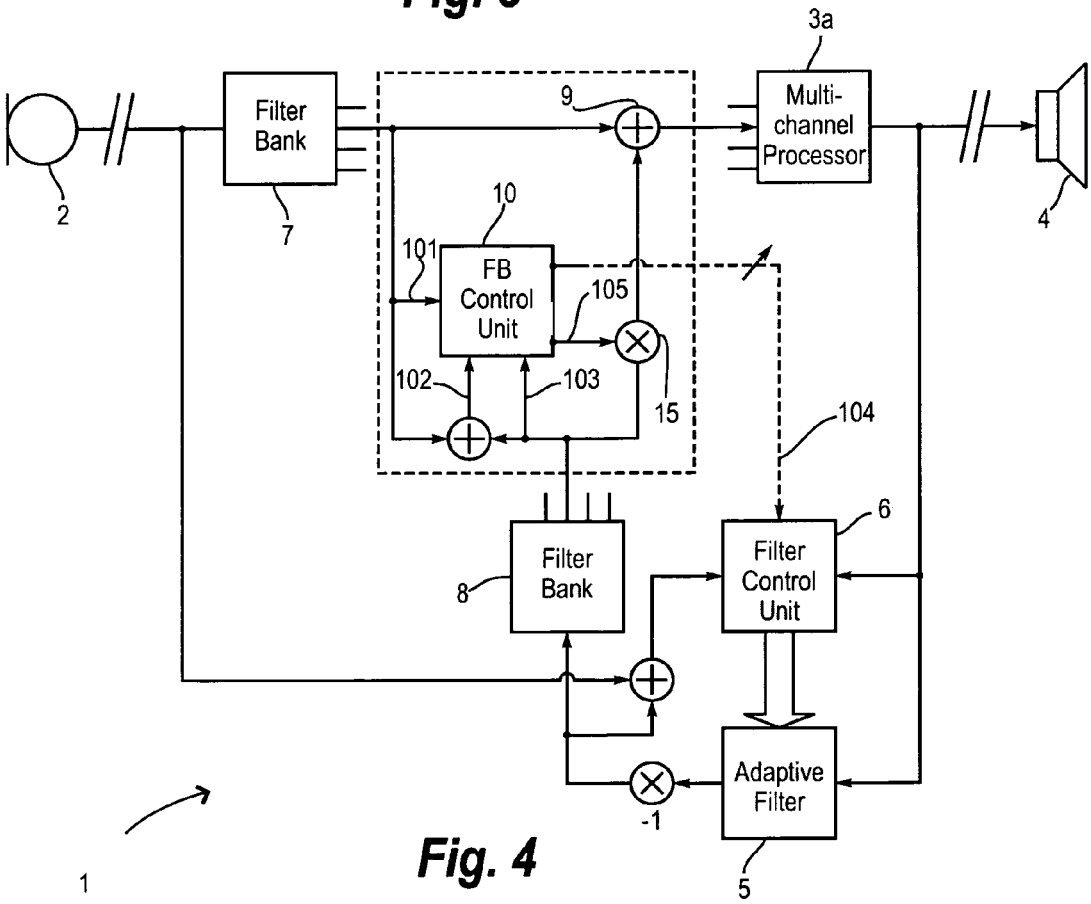
FIG. 4 is a third embodiment of a hearing aid according to the present invention embodying a multichannel hearing aid.

It is particularly advantageous to perform the decision operation of the feedback control unit 10 independently for a number of frequency bands of frequency channels. FIG. 4 shows third embodiment of a hearing aid according to the present invention comprising a plurality of feedback control units 10 corresponding to the number of frequency channels. A first filter bank or FFT (i.e. a Fast Fourier Transformation block) 7 is provided for splitting the electrical input signal from input transducer 2 into a plurality (e. g. 8 or 16) different frequency components. A multi-channel processor 3*a* is provided for processing the signals in the various frequency bands and then combining the processed signals for output by transducer 4.

The hearing aid comprises a further filter bank or FFT 8 for splitting up the feedback cancellation signal into a plurality of frequency components, which are then switched on and off separately by each of the plurality of feedback control units 10, which correspond to the feedback control unit shown in FIG. 2 operating in the specific frequency range.

It may also be possible to provide a plurality of adaptive filters 5 for operation in the different filter bands or FFT tabs. Depending on the structure of the hearing aid and the feedback cancelling algorithm, the required FFT or filter band function may already be present in one or both of these blocks. It may thus not be necessary to actually implement two filter banks in order to provide independent enabling/disabling of the feedback cancellation in different frequency bands.

According to the particular variation of the present invention the decision signal 104 may be used as an input parameter to the adaptation algorithm of the feedback cancellation system illustrated by dotted arrow 104 in FIGS. 1, 3 and 4. A possible application is to increase the adaptation speed of adaptive filter 5 when the cancellation signal is switched off or faded off in the signal path as in this situation artifacts caused by a fast adaptation will not be audible.

Figure 7:
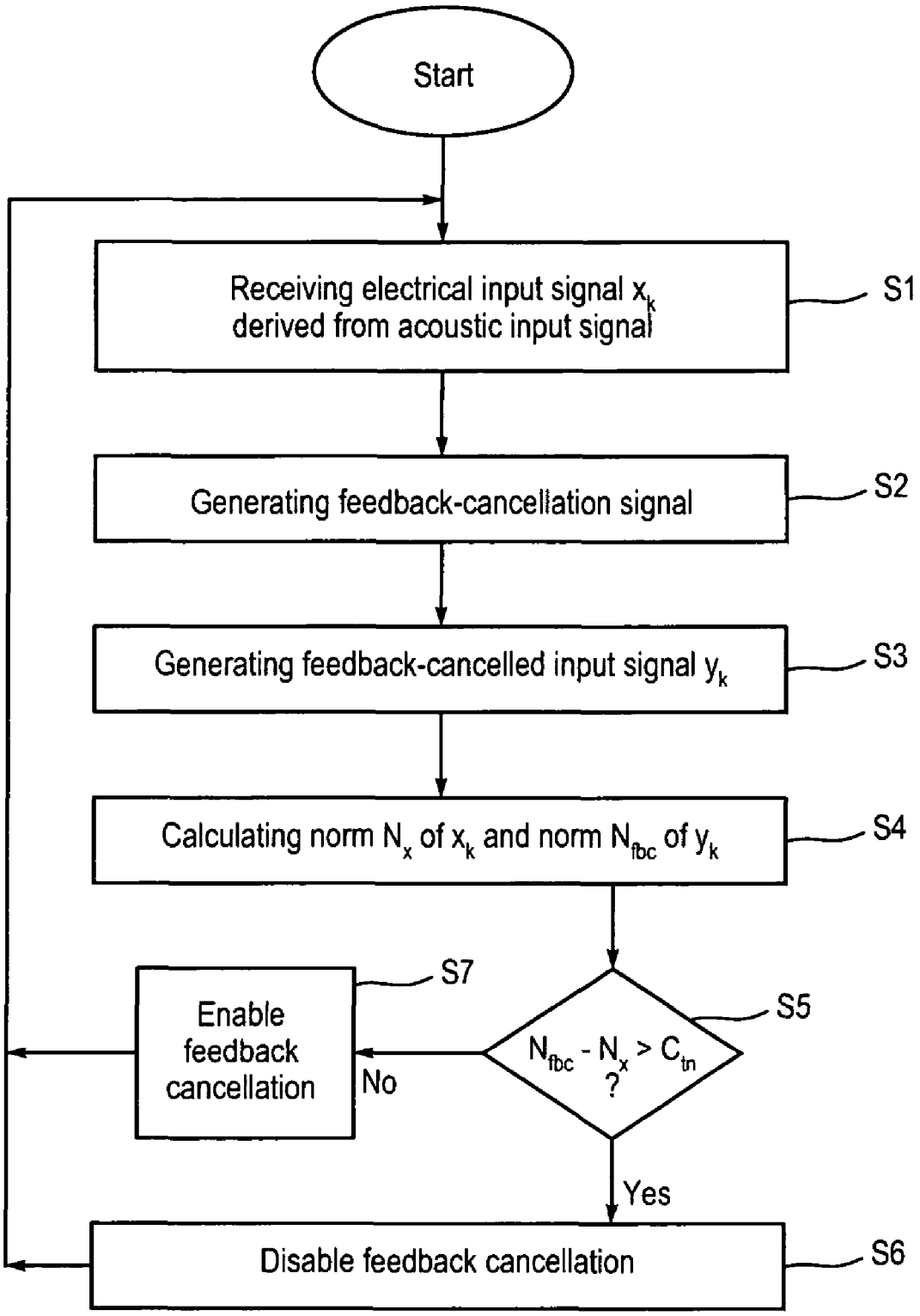
FIG. 7 is a flowchart illustrating a method of reducing acoustic feedback of a hearing aid according to an embodiment of the present invention.

In FIG. 7 is a flowchart illustrating an embodiment of the method of producing acoustic feedback of a hearing aid according to the present invention. The received acoustic input signal is transformed into an electrical input signal $x_k$ by microphone 2 in method step S1. In subsequent method step S2 a feedback-cancellation signal is produced by adaptive filter 5 which is then subtracted from the electrical input signal resulting in feedback-cancelled input signal $y_k$ (step S3). In next step S4 a norm $N_x$ of input signal $x_k$ and norm $N_{fbc}$ of input signal $y_k$ is calculated, as has been described in detail before. The difference of the norm signals, i. e. $N_{fbc}-N_x$ is then compared with a threshold value $c_{th}$ in method step S5. If the comparison result is positive, that is if the difference of the two norms is larger than the given threshold value, it is decided in method step S6 that feedback cancellation is disabled. If, on the other hand, the difference of the norm signals is equal to or smaller than the threshold value feedback cancellation in the signal path of the hearing aid is enabled (method step S7).

The present invention provides a hearing aid with an adaptive filter for feedback cancellation and a method of reducing acoustic feedback of a hearing aid effectively preventing the adaptive filter from actually increasing feedback, at a relatively low computational cost.

The invention claimed is:

1. A hearing aid comprising:

an input transducer for transforming an acoustic input signal into an electrical input signal, a signal processor for generating an electrical output signal, an output transducer for transforming the electrical output signal into an acoustic output signal, an adaptive filter for generating a feedback cancellation signal, a means for subtracting the feedback cancellation signal from the electrical input signal to produce a feedback-cancelled electrical input signal, a norm estimator for generating a first norm signal indicative of a norm $N_x$ of the electrical input signal and for generating a second norm signal indicative of a norm $N_{fbc}$ of the feedback-cancelled electrical input signal, a comparator for comparing the first norm signal with the second norm signal and generating a difference value $N_{fbc}-N_x$ between the norm of the feedback-cancelled input signal and the norm of the electrical input signal, and a decision unit disabling the application of the feedback cancellation signal into the signal path of the hearing aid if the difference value is above a certain threshold value $c_{th}$.

2. The hearing aid according to claim 1, wherein the feedback cancellation signal is supplied to an adaptive filter control unit irrespective of the decision result of the decision unit.

3. The hearing aid according to claim 2, wherein an adaptation speed of the adaptive filter is increased if the difference value $N_{fbc}-N_x$ is above the threshold value $c_{th}$.

4. The hearing aid according to claim 1, wherein the norm estimator calculates the norm signals $N_m$ (m=x, y) of input signal x and feedback-cancelled signal y according to the general formula:

$$N_m = \left(\sum_{k=1}^{L} F_k |m_k|^p\right)^{p^{-1}},$$

wherein $m_k$ is the k-th sample (k=1, . . . L) of the signal m=x, y of which the norm is to be calculated, $F_k$ represents a window or filter function and natural number p is the power of the norm.

5. The hearing aid according to claim 4, wherein power p=1 and the filter function $F_k$ is defined by the following recursive formula:

$$N_m(k)=\lambda|x_k|+(1-\lambda)N_m(k-1),$$

wherein λ is a constant with $0<\lambda\leqq 1$.

6. The hearing aid according to claim 1, wherein threshold value $c_{th}$ is a constant value.

7. The hearing aid according to claim 6, wherein the threshold value $c_{th}=0$.

8. The hearing aid according to claim 1, comprising a threshold value generator for generating a variable threshold value $c_{th}$ as a norm of the feedback cancellation signal multiplied by a threshold factor.

9. The hearing aid according to claim 1, comprising a fading unit for fading in and out of the feedback cancellation signal into the signal path depending on the decision result of the decision unit.

10. The hearing aid according to claim 9, wherein the fading unit operates with a fading time constant between 0.1 s and 5 s, preferably between 0.5 s and 2 s.

11. The hearing aid according to claim 9, wherein the fading function of the fading unit is one of a linear function, a trigonometric function or a polynomial function.

12. The hearing aid according to claim 1, wherein the decision on enabling or disabling the application of the feedback cancellation signal into the signal path of a hearing aid is carried out independently for different frequency bands of the input signal.

13. A method of reducing acoustic feedback of a hearing aid comprising an input transducer for transforming an input signal into an electrical input signal, a signal processor for generating an electrical output signal and an output transducer for transforming the electrical output signal into an acoustic output signal, comprising the steps of:

generating an adaptive feedback cancellation signal, subtracting the feedback cancellation signal from the electrical input signal generating a feedback-cancelled input signal, generating a first norm signal indicative of a norm $N_x$ of the electrical input signal and a second norm signal indicative of a norm $N_{fbc}$ of the feedback-cancelled input signal, comparing the first norm signal with the second norm signal and thereby generating a difference value $N_{fbc}-N_x$, and disabling application of the feedback cancellation signal into the signal path of the hearing aid if the difference value $N_{fbc}-N_x$ is above a certain threshold value $c_{th}$.

14. The method of claim 13, wherein an adaptation speed of the generation of the adaptive feedback cancellation signal is increased if the difference value $N_{fbc}-N_x$ is above the threshold value $c_{th}$.

15. The method according to claim 13, wherein the norm estimator calculates the norm signals $N_m$ (m=x, y) of input signal x and feedback-cancelled signal y according to the general formula:

$$N_m = \left(\sum_{k=1}^{L} F_k |m_k|^p\right)^{p^{-1}},$$

wherein $X_k$ is the k-th sample (k=1, . . . L) of the signal of which the norm is to be calculated, $F_k$ represents a window or filter function and natural number p is the power of the norm.

16. The method according to claim 15, wherein power p=1 and the filter function $F_k$ is defined by the following recursive formula:

$$N_m(k)=\lambda|x_k|+(1-\lambda)N_m(k-1),$$

wherein λ is a constant with $0<\lambda\leqq 1$.

17. The method according to claim 13, wherein the threshold value $c_{th}$ is a constant value.

18. The method according to claim 17, wherein the threshold value $c_{th}=0$.

19. The method according to claim 13, wherein the threshold value is a norm of the feedback cancellation signal multiplied by a threshold factor.

20. The method according to claim 13, wherein the enabling/disabling of the application of the feedback cancellation signal into the signal path of the hearing aid is performed by a soft fading-in/fading-out.

21. The method according to claim 20, wherein the fading time constant is between 0.1 s and 5 s, preferably between 0.5 s and 2 s.

22. The method according claim 20, wherein a linear ramp function, a trigonometric function or a polynomial function is used as a fading function.

23. The method according to claim 20, wherein fading-in and fading-out is performed symmetrically.

24. The method according to claim 20, wherein the fading-in and fading-out is performed asymmetrically.

25. The method according to claim 13, wherein the decision on enabling or disabling the application of the feedback cancellation signal into the signal path of a hearing aid is carried out independently for different frequency bands of the input signal.

26. A computer program product comprising a non-transitory computer readable medium carrying program code for performing a method of reducing acoustic feedback of a hearing aid comprising an input transducer for transforming an input signal into an electrical input signal, a signal processor for generating an electrical output signal and an output transducer for transforming the electrical output signal into an acoustic output signal, said program code when executed causing the following steps to be performed:

generating an adaptive feedback cancellation signal, subtracting the feedback cancellation signal from the electrical input signal generating a feedback-cancelled input signal, generating a first norm signal indicative of a norm $N_x$ of the electrical input signal and a second norm signal indicative of a norm $N_{fbc}$ of the feedback-cancelled input signal, comparing the first norm signal with the second norm signal and thereby generating a difference value $N_{fbc}-N_x$, and disabling application of the feedback cancellation signal into the signal path of the hearing aid if the difference value $N_{fbc}-N_x$ is above a certain threshold value $c_{th}$.

27. An electronic circuit for a hearing aid comprising:

a signal processor for processing an electrical input signal, derived from an acoustic input signal, and generating an electrical output signal, an adaptive filter for generating a feedback cancellation signal, a means for subtracting the feedback cancellation signal from the electrical input signal to generate a feedback-cancelled input signal, a norm estimator for generating a first norm signal indicative of a norm $N_x$ of the electrical input signal and for generating a second norm signal indicative of a norm $N_{fbc}$ of the feedback-cancelled electrical input signal, a comparator for comparing the first norm signal with the second norm signal and generating a difference value $N_{fbc}-N_x$ between the norm of the feedback-cancelled input signal and the norm of the electrical input signal, and a decision unit disabling the application of the feedback cancellation signal into the signal path of the hearing aid if the difference value is above a certain threshold value.

* * * * *